US012471655B2

(12) United States Patent
Kays et al.

(10) Patent No.: US 12,471,655 B2
(45) Date of Patent: Nov. 18, 2025

(54) BASEBALL BATTER'S HELMET

(71) Applicant: VICIS IP, LLC, New York, NY (US)

(72) Inventors: Brendan Kays, New York, NY (US); Jason Neubauer, New York, NY (US)

(73) Assignee: VICIS IP, LLC, New York, NY (US)

( * ) Notice: Subject to any disclaimer, the term of this patent is extended or adjusted under 35 U.S.C. 154(b) by 71 days.

(21) Appl. No.: 18/215,769

(22) Filed: Jun. 28, 2023

(65) Prior Publication Data

US 2023/0413936 A1 Dec. 28, 2023

Related U.S. Application Data

(60) Provisional application No. 63/356,405, filed on Jun. 28, 2022.

(51) Int. Cl.

| | |
|---|---|
| ***A42B 3/08*** | (2006.01) |
| ***A42B 3/06*** | (2006.01) |
| ***A42B 3/12*** | (2006.01) |
| ***A42B 3/32*** | (2006.01) |

(52) U.S. Cl.

CPC ..... *A42B 3/326* (2013.01); *A42B 3/06* (2013.01); *A42B 3/08* (2013.01); *A42B 3/125* (2013.01)

(58) Field of Classification Search

None

See application file for complete search history.

(56) References Cited

U.S. PATENT DOCUMENTS 3,886,596 A * 6/1975 Franklin ..... A61F 9/02 2/9
4,555,816 A * 12/1985 Broersma ..... A42B 3/12 2/908
4,677,694 A * 7/1987 Crow ..... A42B 3/20 2/9
4,744,107 A * 5/1988 Fohl ..... F16B 21/06 24/621
4,766,615 A * 8/1988 Morin ..... A42B 3/08 2/424
7,841,025 B1 * 11/2010 Fink ..... A42B 3/127 2/425
8,201,269 B2 * 6/2012 Maddux ..... A42B 3/18 2/9
9,566,497 B2 * 2/2017 Erb ..... A63B 71/10
(Continued)

FOREIGN PATENT DOCUMENTS

AT 387134 B * 12/1988 ..... A42B 3/326
DE 3129199 A1 * 2/1983 ..... A42B 3/08

OTHER PUBLICATIONS

"Flap." Oxford Languages. 2025 (Year: 2025).*

*Primary Examiner* — Grace Huang

(74) *Attorney, Agent, or Firm* — Ingrassia Fisher & Lorenz, LLP

(57) ABSTRACT

A baseball batter's helmet includes a helmet body having an outer helmet surface and an inner helmet surface, and multiple removable plugs molded into the helmet body at multiple locations. Each removable plug is configured to be removed, thereby forming a through-hole through the inner helmet surface and the outer helmet surface at the respective location of the removable plug on the helmet body. The helmet also includes an attachment component that is removably connected to the inner helmet surface upon removal of one or more of the removable plugs from the helmet body.

26 Claims, 9 Drawing Sheets

(56) References Cited

U.S. PATENT DOCUMENTS

| | | | | |
|---|---|---|---|---|
| 9,775,395 | B2 * | 10/2017 | Teetzel | A42B 3/042 |
| 9,924,754 | B1 * | 3/2018 | Soto | F16B 2/08 |
| 11,464,272 | B2 * | 10/2022 | Melofchik | A42B 3/20 |
| 2008/0092276 | A1 * | 4/2008 | Chiang | A42B 3/324 2/418 |
| 2011/0271430 | A1 * | 11/2011 | Lowe | A42B 3/18 2/425 |
| 2013/0111654 | A1 * | 5/2013 | Gorsen | A42B 3/205 2/421 |
| 2016/0270473 | A1 * | 9/2016 | Warmouth | A63B 71/10 |
| 2017/0196294 | A1 * | 7/2017 | Fischer | A42B 3/127 |
| 2020/0268089 | A1 * | 8/2020 | Mini Townson | A42B 3/205 |
| 2020/0297061 | A1 * | 9/2020 | Ferrari | A42B 3/326 |
| 2022/0175075 | A1 * | 6/2022 | Long | A63B 71/10 |
| 2023/0061962 | A1 * | 3/2023 | Dumph | A42B 3/064 |
| 2023/0309641 | A1 * | 10/2023 | Arzoni | A42B 3/06 2/414 |
| 2024/0008582 | A1 * | 1/2024 | Cohen | A42B 3/326 |
| 2024/0237777 | A1 * | 7/2024 | Chilson | A42B 3/064 |

* cited by examiner

BASEBALL BATTER'S HELMET

CROSS-REFERENCE TO RELATED APPLICATIONS

This application claims the benefit under 35 U.S.C. § 119(e) of U.S. Provisional Application No. 63/356,405, filed on Jun. 28, 2022, the disclosure of which is incorporated by reference herein in its entirety for all purposes.

TECHNICAL FIELD

This disclosure generally relates to helmets, for example, removable structures on helmets adapted for sports.

BACKGROUND

Many modern organized sports employ helmets that are designed to provide the players with significant head protection, with the desire to provide adequate protection from traumatic brain injuries (TBI). Since safety is a primary concern, helmets have continually evolved in an attempt to reduce the risk and rate of concussions and/or other repetitive brain injuries, which can potentially end a player's career early and lead to long-term brain damage.

In baseball, softball, cricket, and other sports with a bat and a thrown ball, helmets typically include an outer helmet shell and a foam layer attached to an interior of the helmet shell. Jaw flaps, chin straps, and face masks can be attached to the helmets, such as mounted to an exterior surface of the helmet shell.

SUMMARY

This disclosure describes helmets, such as baseball batter's helmets.

In some aspects, a baseball batter's helmet includes a helmet body having an inner helmet surface and an outer helmet surface, and multiple removable plugs molded into the helmet body at multiple locations, where each removable plug can be removed, thereby forming a through-hole through the inner helmet surface and the outer helmet surface at the respective location of the removable plug on the helmet body. The helmet also includes an attachment component removably connected to the inner helmet surface upon removal of at least one removable plug from among the multiple removable plugs.

These aspects can include one or more of the following features. The attachment component can include a chinstrap, a jaw flap, a face mask, or a combination of these. The baseball batter's helmet can further include a separate push tool for pushing out a removable plug from the helmet body to form a through-hole at a location on the helmet body corresponding to the removable plug. The attachment component can be removably connected to the inner helmet surface using an attachment mechanism. The attachment mechanism can include at least one of a T-nut and a screw, or a snap connector. The baseball batter's helmet can further include at least one impact mitigating pad affixed to the inner helmet surface. The at least one impact mitigating pad can include vinyl nitrile (VN) foam. The baseball batter's helmet can further include multiple impact mitigating pads affixed to the inner helmet surface and including the first-mentioned impact mitigating pad, where the multiple impact mitigating pads comprise vinyl nitrile (VN) foam. The inner helmet surface can include a first side and a second side opposite to the first side, the removable plugs can include a first set of removable plugs and a second set of removable plugs, the first side can includes the first set of removable plugs molded into the helmet body at a first set of locations, and the second side can include the second set of removable plugs molded into the helmet body at a second set of locations. The baseball batter's helmet can further include a first pad removably attached to the inner helmet surface at the first side. The baseball batter's helmet can further include a second pad removably attached to the inner helmet surface at the second side. The first pad can be removably attached to the inner helmet surface at the first side using a hook-and-loop connector.

Certain aspects of the disclosure encompass a method for assembling a baseball batter's helmet. The method includes removing a removable plug from a first location on a helmet body of a helmet, where the helmet body includes an inner helmet surface and an outer helmet surface and removing the removable plug from the first location forms a through-hole at the first location through the inner helmet surface and the outer helmet surface. The method also includes attaching, at the through-hole at the first location, an attachment component to the inner helmet surface of the helmet body.

These, and other aspects, can include one or more of the following features. The removable plug can be molded into the helmet body at the first location, and removing the removable plug from the first location on the helmet body can include pushing out the removable plug from the helmet body. Pushing out the removable plug from the helmet body can include pushing out the removable plug using a push tool or pushing out the removable plug upon application of manual force against the removable plug. The inner helmet surface can include a first side and a second side opposite to the first side, removing the removable plug from the first location on the helmet body can include removing a first set of removable plugs from a first set of locations on the first side of the inner helmet surface, and attaching the attachment component to the inner helmet surface can include attaching, with an attachment mechanism at through-holes formed at the first set of locations, a jaw flap to the first side of the inner helmet surface. The method can further include, prior to removing the first set of removable plugs, removing a first impact mitigating pad from the first side of the inner helmet surface. The method can further include, after attaching the jaw flap to the first side of the inner helmet surface, affixing the first impact mitigating pad to the jaw flap. The method can further include removing a second set of removable plugs from a second set of locations on the second side of the inner helmet surface, and attaching, with a second attachment mechanism at the second set of locations, a second attachment component to the second side of the inner helmet surface.

In certain aspects, a baseball batter's helmet includes a helmet body having an inner helmet surface and an outer helmet surface, and an attachment component removably connected to the inner helmet surface of the helmet body using a rotational mechanical fastener.

These, and other aspects, can include one or more of the following features. The attachment component can include a jaw flap. The baseball batter's helmet can further include at least one slot formed in the jaw flap that receives the rotational mechanical fastener for fastening the jaw flap to the inner helmet surface, where the slot allows for articulation of the jaw flap when connected to the inner helmet surface. The baseball batter's helmet can further include at least one slot formed in the inner helmet surface that receives the rotational mechanical fastener for fastening the inner helmet surface to the jaw flap, where the slot allows for articulation of the jaw flap when connected to the inner helmet surface. The baseball batter's helmet can further include at least one slot formed in a connection component that is disposed between an outer surface of the jaw flap and the inner helmet surface, and the at least one slot formed in the connection component allows for articulation of the jaw flap when connected to the inner helmet surface. The at least one slot can include two slots, and a separate rotational mechanical fastener engages each of the two slots to removably connect the jaw flap to the inner helmet surface. The jaw flap can be articulated in an upward direction, a downward direction, a forward direction, or a rearward direction. The baseball batter's helmet can further include a removable plug molded into the helmet body at a first location, where the removable plug can be removed, thereby forming the slot that includes a through-hole through the inner helmet surface and the outer surface at the first location, the attachment component can be removably connected to the inner helmet surface upon removal of the removable plug.

In some aspects, a helmet includes a helmet body having an inner helmet surface and an outer helmet surface, and an attachment component removably connected to the inner helmet surface of the helmet body at a first location. The attachment component includes an outer attachment surface shaped to connect and fit with a corresponding inner attachment surface formed in the inner helmet surface of the helmet body.

These aspects can include one or more of the following features. The helmet can further include a removable plug coupled to the helmet body at a second location, where the removable plug is configured to be removed from the helmet body to form a through-hole at the second location through the inner helmet surface and the outer helmet surface. The removable plug can be flush with the outer helmet surface when the removable plug is coupled to the helmet body. The helmet can further include a plurality of impact mitigating pads affixed to the inner helmet surface and including vinyl nitrile foam. At least one impact mitigating pad can be removable from the inner helmet surface. The attachment component can include at least one of a chinstrap, a jaw flap, or a face mask. The helmet body can include a first side and a second side opposite to the first side, and the outer helmet surface of the first side and the second side are recessed from a surface profile of a remainder of the outer helmet surface of the helmet body. The helmet body can partially or completely surround a head of a wearer of the helmet, where the first side of the helmet body defines a first ear flap to cover a first ear of the wearer, and the second side of the helmet body defines a second ear flap to cover a second ear of the wearer.

BRIEF DESCRIPTION OF THE DRAWINGS

Like reference numbers and designations in the various drawings indicate like elements.

DETAILED DESCRIPTION

Figure 1:
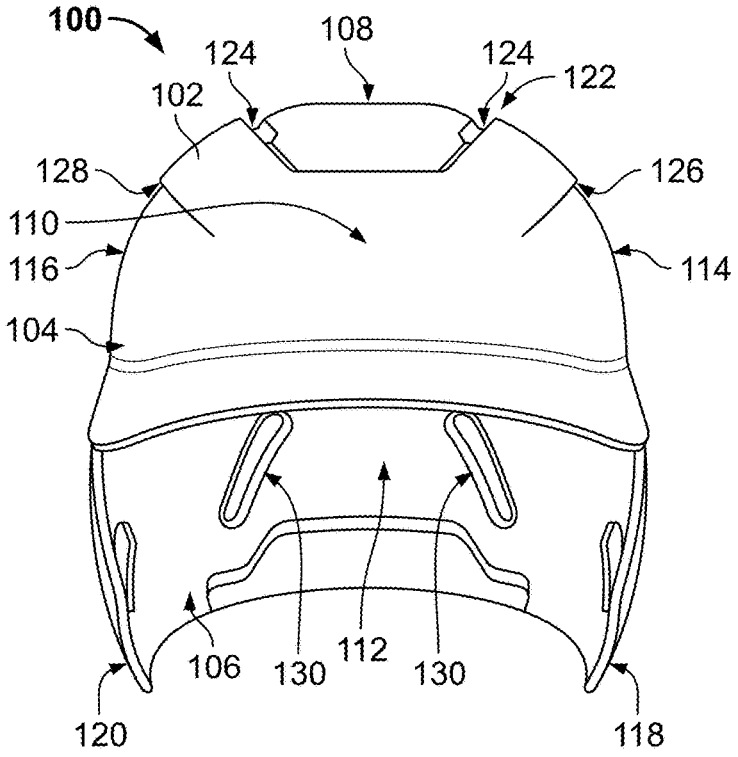
FIG. 1 is a front view of a first example helmet.

This disclosure describes helmets, such as batter's helmets adapted for baseball, softball, or other sports, which include a helmet body and an attachment component (e.g., a jaw flap, chin strap) that is removably connected to an inner helmet surface of the helmet body via one or multiple through-holes formed in one or more locations in the helmet body upon removal of removable plugs from such one or more locations. The attachment component includes a surface that removably connects to through-holes formed at the locations of removable plugs formed in the helmet body, and/or includes an outer attachment surface that partially or completely contacts the inner helmet surface of the helmet body. The attachment component is removable, in that the attachment component can be readily removed from or connected to the helmet body using an attachment mechanism (e.g., T-nut, screws) that selectively attaches (e.g., able to connect to or disconnect from) the attachment component to the helmet body. In some instances, the attachment component extends beyond an outer perimeter of the helmet body of the helmet, for example, to create an extension of the helmet intended to shield and/or protect an additional region of a wearer's head (or another body part, e.g., neck). The attachment component can include a jaw flap, face mask, or chinstrap, or other component desired to be attached and/or removed from the helmet body. For example, a jaw flap can include an outer attachment surface with an outer surface profile that partially or completely matches an inner surface profile of an ear flap portion of the helmet, where the outer surface profile of the jaw flap contacts the corresponding inner surface profile of the ear flap portion, and an attachment mechanism on the jaw flap or other attachment component (e.g., hole(s) formed in portions of the jaw flap or other attachment component corresponding to locations of hole(s) in the helmet) are coupled to through-holes(s) formed at the ear flap portion of the helmet body, via a fastening mechanism (e.g., a T-nut, screw, etc.).

The inner surface of the helmet body is equipped with one or more impact mitigating pads, where one or more of the impact mitigating pads can be removable from the inner helmet surface of the helmet body, for example, in order to connect the attachment component to a particular portion of the inner helmet surface. The impact mitigating pads can include foam, air, or both, to cushion a wearer's head when the wearer wears the helmet. In some examples, the impact mitigating pads include vinyl nitrile (VN) foam.

The helmet can include one or more removable plugs coupled to the helmet body at one or more locations on the helmet body, and the removable plugs can plug some or all of the locations when the plugs are present and coupled to the helmet body, or reveal through-holes through the inner and outer helmet surfaces of the helmet body when corresponding removable plugs are removed from the helmet body. In some implementations, the removable plugs are flush with the outer helmet surface to create a smooth appearance from an exterior view of the helmet. The removable plug(s) can be molded into the inner helmet surface at one or more locations (s), and the removable plug(s) can be removed from the inner helmet surface to form through-holes through the inner and outer helmet surfaces of the helmet body, for example, when one or more plugged locations on the helmet body are needed to couple an attachment component to the helmet body. The removable plugs can be removed in a variety of ways, such as with a separate push tool for pushing out the removable plug(s), with the application of manual force (e.g., with a user's hands), or another appropriate manual or machine-based technique for removing the plugs.

The helmet body and the impact mitigating pad(s) surround at least part of the wearer's head and help protect the wearer of the helmet from impacts by reducing, distributing, and/or or mitigating the effect of impacts to the helmet onto the wearer. A helmet is designed to protect a wearer from blunt impacts to the head. To mitigate such impacts, a helmet includes one or more impact mitigating pads on the interior surface of the helmet body between the wearer's head and the inner helmet surface. The impact mitigating pads are designed to slow accelerations in an impact to protect the head of the wearer, and the material, stiffness, density, and design of the pads can be adjusted to manage particular impact speeds that are likely to be experienced by the wearer upon impact. For example, impact mitigating pads made from vinyl nitrile (VN) foam provide sufficient impact resistance with a reduced pad thickness as compared to conventional foam pads. The impact mitigating pads can be appropriately fit to the wearer's head for comfort, and can be continuous from the helmet body to the surface of the wearer's head. The impact mitigating pads can be elastic, cushioned, and comfortable against a wearer's head to mitigate impact forces to the wearer.

Conventional baseball batter's helmets include ethylene-vinyl-acetate (EVA) foam for their impact mitigating pads. Conventional helmets also include a bump out shape for their ear flaps where the exterior surface of the helmet radially protrudes from the remainder of the helmet shell outer profile and include pre-formed through-holes through the helmet shell at several locations, and attachments to conventional helmets typically attach on an outer surface of the helmet shell. In the present disclosure, (1) helmet attachments connect at an inner surface of the helmet body, (2) a helmet attachment (such as a jaw flap) can include a flush outer surface profile with an ear flap portion of the helmet (or other applicable portion of the helmet where the attachment is connected) for a more fluid, continuous exterior look of the helmet, (3) one or both ear flaps of the helmet (or other applicable portion of the helmet) can include a recessed surface profile relative to the surface profile of a remainder of the outer helmet surface, (4) impact mitigating pads are made from vinyl nitrile (VN) foam with a lower profile than conventional foam pads while offering the same or improved impact resistive performance (as provided by other types of EVA foam), (5) one or more locations in the helmet shell can be initially plugged by removable plugs that are flush with the outer surface of the helmet prior to attachment of an attachment component, (6) impact mitigating pads can be removable from an interior surface of the helmet shell and re-attached at the same or different positions, or a combination of these features. Advantages of a helmet of the present disclosure include a continuous, cohesive design and appearance across the outer surface of the helmet plus any connected attachment component(s), and using vinyl nitrile (VN) foam provides improved impact properties (e.g., as compared to EVA foam) that allows for the use of thinner impact mitigating pads and a smaller helmet profile as compared to bulkier conventional helmets. A helmet of the present disclosure provides a cohesive, aesthetic, and overall smaller profile and appearance as compared to conventional batter's helmets.

One or more locations on the helmet body can be used to mount one or more attachment components to the helmet. Conventional helmets have multiple hardware through-holes already formed in the helmet shell, regardless of whether each hole is used to mount an attachment component. As such, if an attachment component is not coupled to such holes, the holes remain visible and apparent in the helmet shell of conventional helmets. In the present disclosure, some or all of the aforementioned locations in the helmet shell include removable plugs that are inserted, molded into, integrally formed with, or otherwise coupled to the helmet shell and are flush with the outer helmet surface to provide a smooth and continuous surface profile of the outer helmet surface at and surrounding the locations for attachment points or holes. In some implementations, the removable plugs can be molded with or otherwise integrally formed with the helmet body, and integrally forming the removable plugs with the helmet body can produce a smooth and continuous outer surface of the helmet body across the locations of the plugs and the surrounding outer helmet surface. One or more or all of the removable plugs can be removed from the helmet in order to form through-holes at the locations of the respective through-holes, for example, and to connect one or more attachment components with the formed through-holes after removal of corresponding removable plugs. One or more or all removable plugs can be removed from the helmet, such as with a manual hand-driven push tool, by another type of tool, or by hand, to disconnect the removable plugs from the helmet body and thereby form through-holes in the location(s) corresponding to the removed plug(s). In this arrangement, a user (such as a wearer, helmet assembler, or other) can remove a subset of removable plugs from the helmet body where through-holes are needed to attach an attachment component, whereas a remainder of the locations with removable plugs can remain plugged with their respective removable plugs, for example, to maintain the continuous, smooth profile of the outer surface of the helmet over the remainder of the outer helmet surface and plugs.

Figure 6:
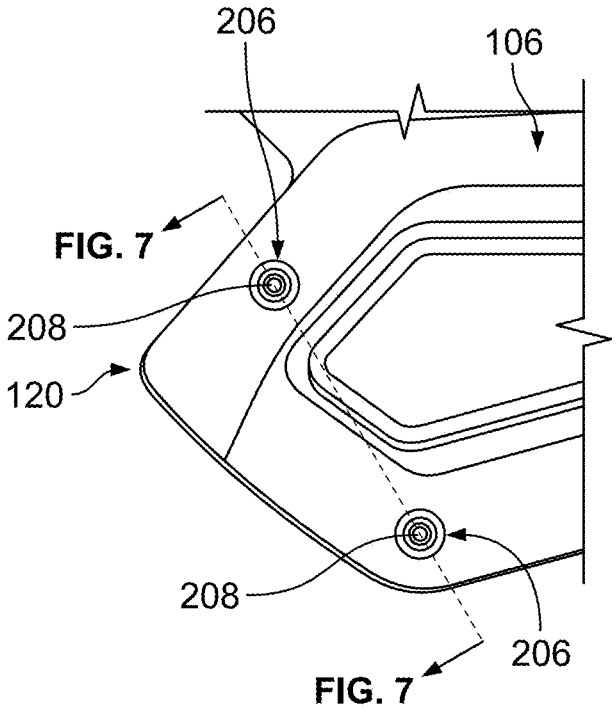
FIGS. 6 and 7 are a right side, interior partial view and a cross-sectional partial front view, respectively, of the second ear flap portion of the second example helmet of FIG. 2.

In the present disclosure, a removable plug is formed at a particular location in the helmet body by forming a recessed portion on the inner helmet surface at the particular location, where the recessed portion is recessed at the particular location relative to the adjacent portions of the inner helmet surface (as depicted in FIG. 6). As shown in FIG. 6, the recessed portion extends partially, but not entirely, through the body of the helmet, such that no through-hole is formed through both the inner and outer helmet surfaces prior to the plug being removed. The removable plug may be separately formed from or integrally formed with (e.g., molded into) one or both of the inner helmet surface or the outer helmet surface of the helmet shell.

FIG. 1 is a front view of a first example helmet 100 that can be worn on a head of a wearer (not shown), such as during a sporting activity (e.g., baseball, football, lacrosse, etc.). The first example helmet system 100 includes a helmet body 102 including an outer helmet surface 104 defining an exterior of the helmet body 102 and an inner helmet surface 106 defining an interior of the helmet body 102. The helmet 100 can include additional components, including impact mitigating pads (e.g., see FIGS. 9-10) or other impact mitigating structures not shown in FIG. 1, which would be understood by a person of ordinary skill in the art of helmet systems.

The helmet body 102 forms a shell of the example helmet 100, and at least partially surrounds a head of the wearer when the example helmet 100 is worn. The helmet body 102 can be shaped to fit on a wearer's head, and can include regions designed specifically for head and neck regions and/or facial features of a wearer. For example, the helmet body 102 includes a crown portion 108 at a top of the helmet body 102, a forehead portion 110 positioned at a front of the helmet body 102, a rear portion 112 position at a rear of the helmet body 102, a first side portion 114 positioned at the wearer's left side, a second side portion 116 positioned at the wearer's right side, a first ear flap portion 118 positioned to cover the wearer's left ear, and a second ear flap portion 120 positioned to cover the wearer's right ear. The multiple portions of the helmet body 102 can be integrally formed and continuous with each other, can be separately formed and connected together, or a combination of these.

In some implementations, the helmet body 102 includes multiple slit openings 122 through the helmet body 102 (e.g., partially or completely through the thickness of the helmet body 102 between the outer helmet surface 104 and the inner helmet surface 106). The slit openings 122 are disposed over various zones of the example helmet 100, such as along the top, sides, and rear of the helmet 100. The slit openings 122 create flexible portions of the helmet body 102 between the slit openings 122, and these flexible portions of the helmet body 102 can have varying stiffness. For example, the stiffness of the flexible zones can vary at the longitudinal ends of the flexible portions, at a center of the flexible portions, and/or at intermediate areas of the flexible portions between the center and the ends. In some instances, the slit openings 122 and the corresponding flexible portions in the helmet body 102 between slit openings provides for varying stiffness at different zones across the helmet body 102 and by extension, varying an impact response at the different zones of the example helmet 100. For example, a conventional spherical helmet generally has the same stiffness throughout the helmet such that an impact to the helmet has the same impact response, regardless of where the impact was made on the spherical helmet. In contrast, the example helmet 100 formed with parallel (or generally parallel) or spaced apart slit openings 122 in some portions of the helmet body 102 but not others allows the example helmet 100 to have varying impact responses, e.g., certain portions of the helmet body 102 can be stiffer (e.g., at the forehead portion 110, the first side portion 114, the second side portion 116, or a combination of these regions) and offer a particular impact response compared to the flexible zones (defined by the spaces between the slit openings 122) that are relatively more flexible and offer a different impact response (e.g., at the crown portion 108, the rear portion 112, first ear flap 118, second ear flap 120, or a combination of these). Thus, the use of slit openings 122 and the defined flexible zones therebetween allows customizing and adjusting the impact response for different portions of the example helmet 100. In doing so, the example helmet 100 can be further outfitted with impact absorbing pads or other materials that are customized for the areas of the example helmet 100 corresponding to the flexible zone(s) as well as for other portions of the example helmet 100 having different stiffness (e.g., higher stiffness).

In the example helmet 100 of FIG. 1, multiple slit openings 122 are shown disposed about the helmet body 102, mostly running longitudinally (e.g., front to rear, or top to bottom). The slit openings 122 can be formed as cuts in the helmet body 102 of the example helmet 100 that extend from the outer helmet surface 104 to the inner helmet surface 106, or as cuts in recessed channels of the example helmet 100, or a combination of these.

The slit openings 122 of the example helmet shell 100 includes a pair of top slit openings 124 along the crown region 108, a first top side slit opening 126 extending along a left side of the helmet body 102 toward the rear portion 112, a second top side slit opening 128 extending along a right side of the helmet body 102 toward the rear portion 112 (e.g., mirroring the first top side opening 126 on the opposite side of the helmet 100), and a pair of rear slit openings 130 extending along the rear portion 112 of the helmet body 102 in a generally vertical direction and toward a bottom edge of the rear portion 112 of the helmet body 102. Other helmet embodiments may include a different arrangement of slit openings 122, additional openings, or fewer openings in the helmet body 102 than the slit openings depicted in the example helmet 100 of FIG. 1.

The helmet body 102 can be manufactured from a rigid or substantially rigid material, such as polyethylene, nylon, polycarbonate materials, acrylonitrile butadiene styrene (ABS), polyester resin with fiberglass, thermosetting plastics, and/or other rigid thermoplastic materials. Alternatively, the helmet body 102 can be manufactured from a relatively deformable material, such as polyurethane and/or high-density polyethylene, where such material allows some flexibility and/or local deformation of the helmet body 102 upon impact, but provide sufficient rigidity to prevent breakage or damage to the helmet body 102. The helmet body 102 can be formed of a continuous, single shell, or a multi-piece assembly (e.g., a two-piece shell assembly of a front shell and a back shell) that conforms to and surrounds the head of the wearer.

In some implementations, the helmet 100 includes one or multiple impact mitigating pads (e.g., see impact mitigating pads 302 in FIGS. 9-10) connected to the helmet. The impact mitigating pad(s) can be affixed to the inner helmet surface 106 throughout all or a portion of the inner helmet surface 106. In the present disclosure, the impact mitigating pad(s) forms all or a portion of an impact mitigating layer of the first example helmet 100, and reacts to impacts against the example helmet 100 with a dynamic, cushioned, collapsible, and/or reformable support between the helmet body 102 and the wearer of the helmet 100. The impact mitigating pads are formed of a cushioning material, such as foam, air, or a combination of these, and act to cushion the head of the wearer of the helmet 100 against impact forces on the helmet body 102. In some examples, the impact mitigating pad(s) include vinyl nitrile (VN) foam. VN foam provides improved impact properties compared to EVA foams. VN foam includes a vinyl nitrile polymer, though properties of different VN foams can vary based on desired performance characteristics of the VN foams. In some examples, VN foams can vary in Shore hardness between 45 and 95, can vary in density between 5.51 and 17.50 pounds per cubic foot (pcf), can vary in tensile strength between 112 and 370 pound force per square inch (PSI), can vary in tear strength between 2.5 kilograms per centimeter (kg/cm), can vary in minimum elongation between 120 percent (%) and 180%, or a combination of these performance characteristics. With these improved performance properties, VN foams allow for an improved cushioning and impact mitigation compared to other foams of the same thickness, or allows for the same or better cushioning and impact mitigation at a reduced thickness as compared to other foams. With the reduced thickness of VN foams, the overall profile of the example helmet 100 can be reduced while fitting the same size of a wearer's head as compared to a conventional helmet that requires thicker foam pads and therefore a bulkier, larger helmet shape profile.

The impact mitigating pads can be removably attached to the inner helmet surface 106, for example, for removal from and/or reattachment to the helmet body 102. In some instances, one or more or all of the impact mitigating pads are removably attached to the inner helmet surface with a connector. The connector can include a hook-and-loop fastener, adhesive, or other type of connector that allows for the pad to be removed and reaffixed to the helmet body 102.

Figure 2:
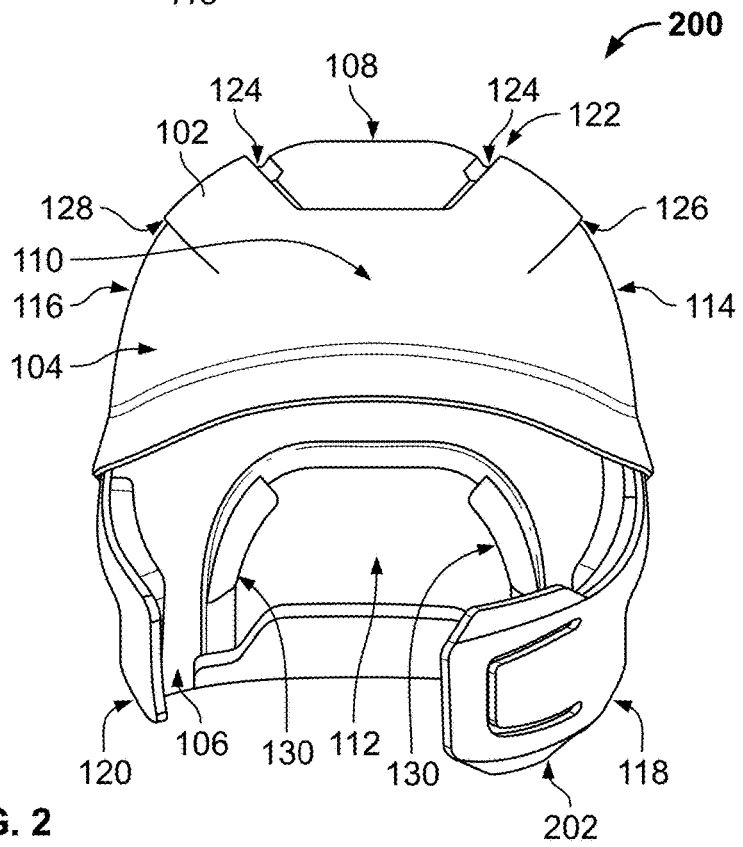
FIG. 2 is a front view of a second example helmet including a removable jaw flap.
Figure 3:
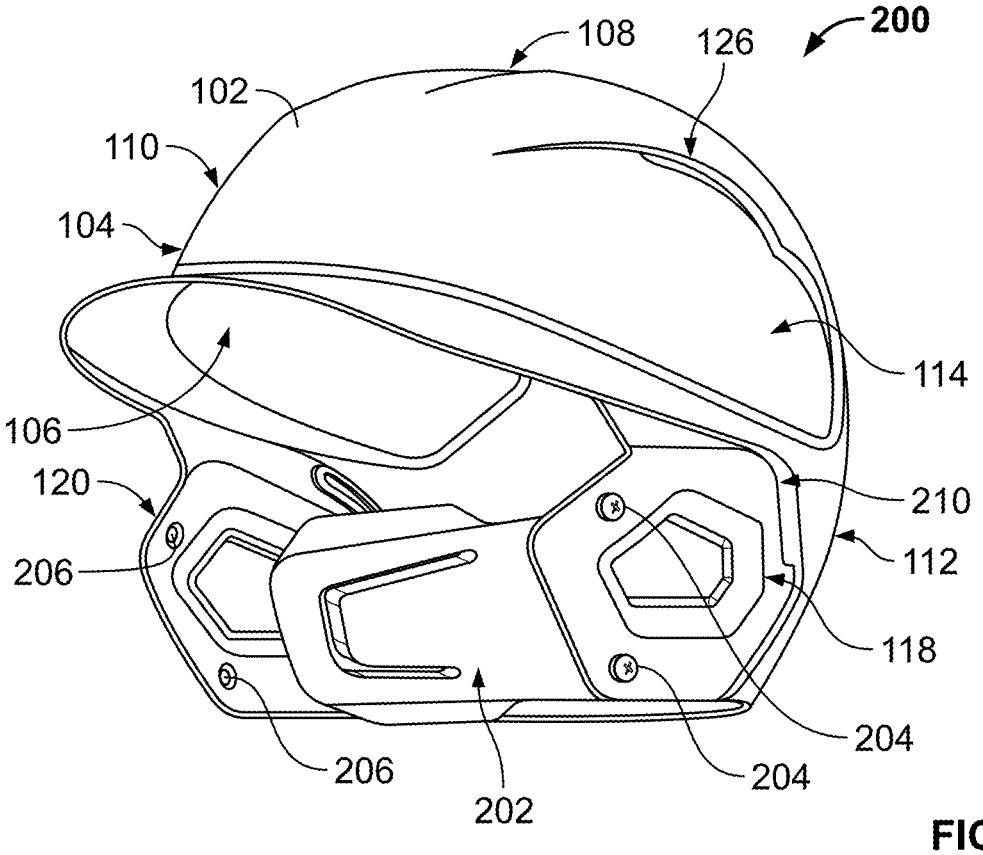
FIG. 3 a perspective view of the second example helmet of FIG. 2.

FIGS. 2 and 3 are a front view and a perspective view, respectively, of a second example helmet 200 that includes a type of an attachable component, namely a removable jaw flap 202. The second example helmet 200 of FIG. 2 is the same as the first example helmet 100 of FIG. 1, except that the second example helmet 200 includes a connected jaw flap 202 and associated connection hardware. The helmet body 102 includes removable plugs at multiple locations on the helmet body 102 that provide attachment points for coupling attachment components to the helmet body 102. In the second example helmet 200 of FIGS. 2 and 3, such locations with removable plugs include a first set of locations 204 in the first ear flap 118 (two through-holes shown) and a second set of locations 206 in the second ear flap 120 (two locations shown), where the jaw flap 202 connects to the first ear flap 118 at the first set of locations 204. The example helmet body 102 can include fewer locations or additional locations (with removable plugs) than those shown in the second example helmet 200. Upon removal of a removable plug from one or more of these locations, through-hole(s) are formed in the respective locations that extend through helmet body 102, specifically, through the inner helmet surface 106 and in some instances, the outer helmet surface 104. The locations and the corresponding removable plugs are described in greater detail with respect to FIGS. 4A-7.

The second example helmet 200 includes a jaw flap 202 that is selectively attached to (e.g., removable from and re-attachable to) the helmet body 102. Although the second example helmet 200 shows the attachment component as the jaw flap 202, the type of attachment component can vary. For example, the attachment component can include a face mask, chin strap, plate extension, or other helmet attachment such as those used during sports. The attachment component is selectively attached to the helmet body 102 at one or more locations in the first set of locations 204, and can be removed from the helmet body 102 by disengaging the attachment component from the one or more such locations. The attachment component can include an attachment mechanism that engages with through-holes at one or more of the locations for removably connecting the attachment component to the helmet body 102. The attachment mechanism can vary. In some examples, the attachment mechanism includes a T-nut and a screw, a snap connector, a combination of these, or another releasable fastener type. In the second example helmet 200 of FIG. 2-3, the jaw flap 202 engages with the inner helmet surface 106 of the first ear flap 118, in that an outer attachment surface of the jaw flap 202 partially contacts the inner helmet surface 106 of the helmet body 102. With the jaw flap 202 connecting to the helmet body 102 at the inner helmet surface 106, the outer surface profile of the second example helmet 200 is consistent (e.g., not disjointed), and the jaw flap 202 can be shaped to be flush with the outer helmet surface 104 to provide a substantially flush outer surface profile between the first ear flap 118 and the jaw flap 202. These continuous, flush surface profiles provide a more fluid, continuous exterior surface and appearance of the helmet. Although this description is provided with respect to connection of the jaw flap 202 to the ear flap 118, a skilled artisan will appreciate that similar connections can be formed by coupling other attachment components to the helmet shell at these or other locations via one or more other locations (with removable plugs) formed in the helmet.

In some implementations, such as in the second example helmet 200 of FIGS. 2 and 3, the first ear flap 118, second ear flap 120, or both, include a recessed outer surface profile relative to the surface profile of a remainder of the outer helmet surface 104. In certain instances, the first ear flap 118, second ear flap 120, or both are separated from the remainder of the outer helmet surface by a recessed channel 210 that partially or completely isolates the outer surface of the ear flaps 118 and 120 from the remainder of the outer helmet surface. In some implementations, the first ear flap 118 defines a first side (or second side) of the example helmet 200, such that an attachment component (e.g., jaw flap) attaches to the first side of the helmet 200 at the inner helmet surface of the first side, at the locations of the removable plugs on the first side (e.g., the first set of locations 204), or both. Similarly, the second ear flap 120 can define a second side (or first side) of the example helmet 200, such that the same attachment component or a different attachment component can attach to the second side of the helmet 200 at the inner helmet surface of the second side, at the location(s) of removable plugs at the second side (e.g., the second set of locations 206), or both.

Figure 5:
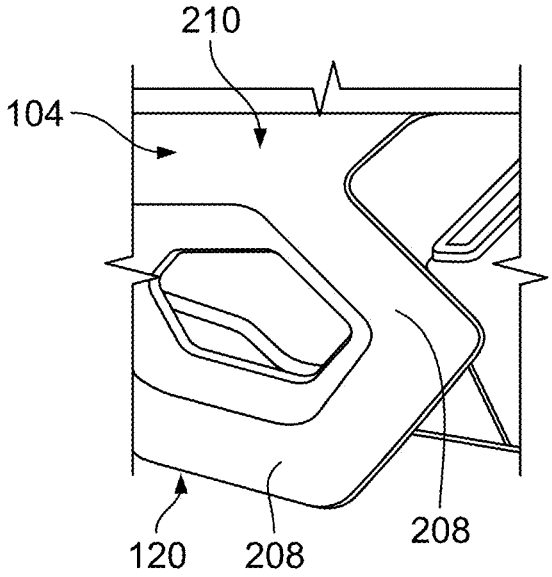
FIG. 5 is a partial left perspective view of the second example helmet of FIG. 2 showing a second ear flap portion of the helmet.
Figure 7:
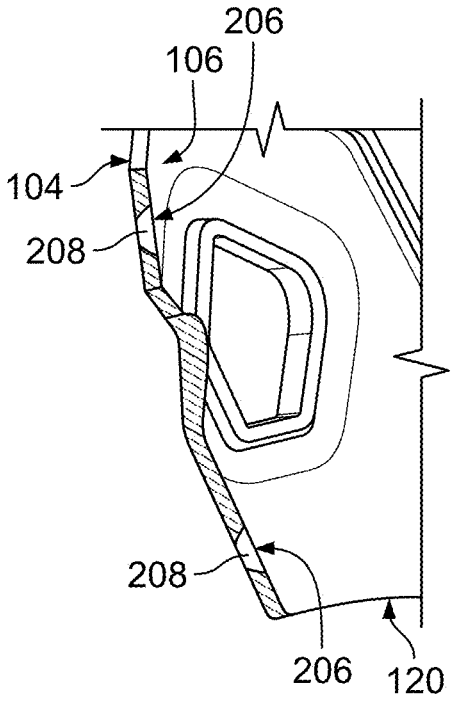

Multiple visible through-hole openings through a helmet shell may provide an unpolished and unclean look from an exterior view. In the second example helmet 200 of FIGS. 2-3, the first set of locations 204 and the second set of locations 206 are initially plugged with removable plugs 208 that are flush with the outer helmet surface 104 of the helmet body 102. The flush outer surface profile of the second example helmet 200 with the removable plugs 208 provides a clean and polished look from the exterior, while still allowing for all or some of the removable plugs 208 to be removed if the respective location(s) they are plugging are required for attaching an attachment component (e.g., the jaw flap 202). FIG. 5 is a partial left perspective view of the second example helmet 200 of FIGS. 2-3 showing the second ear flap portion 120 of the second example helmet 200 and two removable plugs 208 that are flush with the outer helmet surface 104. From the left side view of the second ear flap 120 of the second example helmet 200 in FIG. 5, the outer helmet surface 104 is continuous across the removable plugs 208, which cover the second set of locations 206. FIGS. 6 and 7 are a right side, interior partial view and a cross-sectional partial front view, respectively, of the second ear flap portion 120 of the second example helmet 200 of FIGS. 2-3 and 5. The removable plugs 208 are inserted, molded into, integrally formed with, or otherwise coupled to the helmet body 102 and are flush with the outer helmet surface 104, for example, to provide a smooth and continuous surface profile of the outer helmet surface 104 at and surrounding the locations of the removable plugs.

In the second example helmet 200, the removable plugs 208 are molded into the helmet body 102 at the second set of locations 206 to entirely cover the second set of locations 206 adjacent to the outer helmet surface 104. Inward from the removable plug(s), the partial holes in the helmet body 102 at the locations 206 can have a cylindrical shape or another shape (e.g., square, rectangle), and the removable plugs 208 have a corresponding shape (or other, larger shape) to fill, cover, or otherwise plug the second set of locations 206 and form the continuous outer surface profile of the outer helmet surface 104 across the second set of locations 206. The shape and profile of the removable plugs 208 can vary, for example, to match a curved, straight, jagged, or other shaped profile of the outer helmet surface 104. The removable plugs 208 of the second example helmet 200 depicted in the cross-sectional view of FIG. 7 plug an outer end of the second set of locations 206, while still exposing a recessed portion of the location 206 recessing from the inner helmet surface 106. The removable plugs 208 are coupled to the helmet body 102 and are disposed at least partially within the holes at the second set of locations 206. In certain instances, the removable plugs 208 extending only partially into the helmet body at the second set of locations 206 to allows for the recessed portions of such locations 206 to be visible from an interior of the second example helmet 200, for example, for readily identifying the location(s) of the corresponding removable plugs 208. Readily identifying these locations can aid a user when a user desires to remove one or more of the plugs 208. In other instances, the removable plugs 208 can fill a majority or an entirety of the space defining the locations 206 (on both the inner and outer helmet surfaces and the space between these surfaces). In some examples, the removable plugs 208 do not extend inward beyond the surface profile of the inner helmet surface 106, for example, so as not to impede or protrude into an impact mitigating pad affixed to the inner helmet surface 106 over one or more of the locations of removable plugs.

One or more or all of the removable plugs 208 can be removed from the helmet body 102 in order to reveal one or more through-hole(s) through the helmet body 102 and readily visible on the outer helmet surface 104. Removing the removable plugs 208 allows for the connection of one or more attachment components to the exposed through-holes at respective locations of the through-holes. One or more or all removable plugs 208 can be removed from the helmet body 102, for example, by the application of force against the removable plugs 208. The application of force can be provided by hand (e.g., manual force by a user), with a push tool, or by other applications of force against the removable plug(s).

Figure 8:
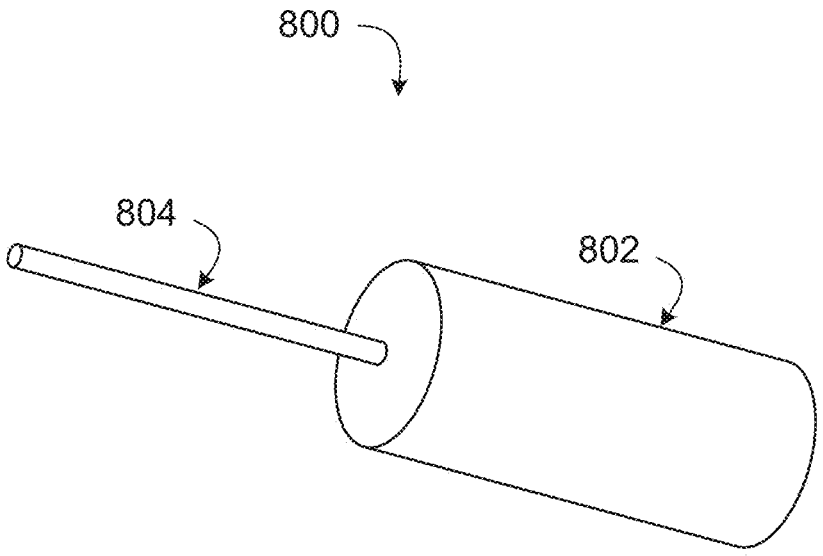
FIG. 8 is a schematic perspective view of an example push tool that can be used in the example helmet of FIG. 1 or the second example helmet of FIG. 2.

In some implementations, a manual hand-driven push tool is used disconnect the removable plugs 208 from the helmet body 102, for example, where through-holes are needed to be exposed in order to attach an attachment component or as desired for other reasons. FIG. 8 is a is a schematic perspective view of an example push tool 800 that can be used in the example helmet 100 of FIG. 1 or the second example helmet 200 of FIGS. 2-3. The example push tool 800 can define a manual hand-driven push tool that engages with and pushes a removable plug for removal from the helmet body. The example push tool 800 includes a handle 802 and a shaft 804 connected to the handle 802. The handle 802 can be grasped by a user, and a distal end of the shaft 804 can be positioned against a removable plug, where an application of force by the example push tool 800 against the removable plug can remove the removable plug from the helmet body 102. In some instances, the shaft 804 is cylindrical, and includes a diameter that is smaller than a diameter of one or more of the holes or recessions in the inner helmet surface 106 at respective locations 204, 206 of the removable plugs 208 such that the shaft 804 can readily access a removable plug 208 through the helmet body 102 at these locations 204, 206, if needed for removal of a plug. The shape and profile of the example push tool 800 can vary, and can include additional components and features equipped to aid in the removal of one or more removable plugs from the helmet body 102.

In some implementations, a user can remove a subset of removable plugs 208 out of the total removable plugs 208 from the helmet body 102 where through-holes are needed to attach an attachment component, whereas a remainder of the locations with removable plugs 208 can remain plugged, for example, to maintain the continuous, smooth profile of the outer helmet surface 104 of the helmet 200 over the remainder of the plugs 208. In the second example helmet 200 of FIGS. 2-3 and 5-7, the first set of locations 204 do not include removable plugs in order to allow for the jaw flap 202 to connect to the helmet body 102 via through-holes thereby formed at the first set of locations 204, whereas the helmet body 102 includes the removable plugs 208 plugging the second set of locations 206 on the second ear flap portion 120.

Figure 4A:
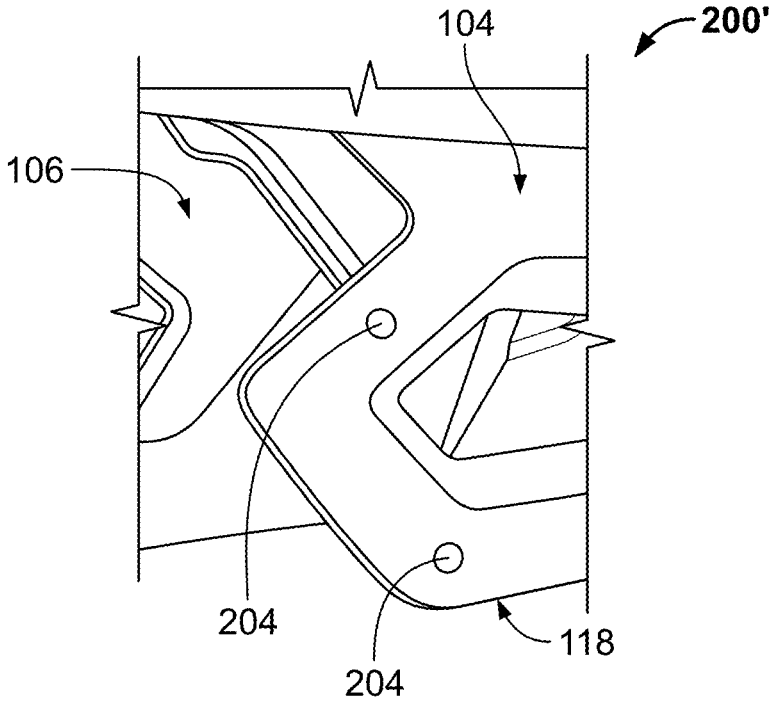
FIG. 4A is a partial right perspective view of the second example helmet of FIG. 2 modified to show an ear flap portion of the second example helmet.

FIG. 4A is a partial right perspective view of a modified version of the second example helmet 200 of FIG. 2 showing the first ear flap portion 118 of the helmet 200. In the second example helmet 200' of FIG. 4A, the removable jaw flap 202 is excluded from the helmet 200' and removable plugs at the first set of locations 204 have been removed to show the through-holes formed at the first set of locations 204. The modified example helmet 200' of FIG. 4A is the same as the second example helmet 200 of FIGS. 2 and 3, except the jaw flap 202 is disconnected from the helmet body 102. The first ear flap 118 is shown after the removable plugs are removed from the helmet body 102 over the first set of locations 204. The first set of locations 204 define through-holes through the helmet body 102 from the inner helmet surface 106 to the outer helmet surface 104. An attachment component can attach to the first ear flap 118 using an attachment mechanism that engages with through-holes formed at the first set of locations 204 (upon removal of removable plugs from these locations). For example, the jaw flap 202 can include one or more pins, tabs, screws (e.g., T-nut and screw), snap connectors, or other removable fasteners or permanent fasteners for engaging with the through-holes at the first set of locations 204.

The jaw flap 202 (or other attachment component) can connect to the helmet body 102 by engaging with the through-holes formed at the first set of locations 204, contacting an outer surface of the jaw flap 202 with a portion of the inner helmet surface 106 at the first ear flap 118, or a combination of these, in order to fasten the jaw flap 202 attachment component to the helmet body 102. In some implementations, the jaw flap 202 includes additional features or components that aid in connecting the jaw flap 202 to the helmet body 102, such as additional fasteners, ridges that engage with ledges formed on the inner helmet surface of the helmet body 102, ledges that engage with ridges formed on the inner helmet surface of the helmet body 102, or other features.

During assembly of the jaw flap 202 onto the helmet body 102, one or more impact mitigating pads previously present on the inner helmet surface 106 at the first ear flap 118 can be removed to allow for the placement of the jaw flap 202 against the inner helmet surface 106 at the first ear flap 118. In some instances, after the jaw flap 202 is connected to the helmet body 102, the one or more impact mitigating pads can be re-applied to an inner surface of the jaw flap 202, and/or additional impact mitigating pad(s) can be applied to the inner surface of the jaw flap 202. Although the second example helmet 200 is described with respect to a jaw flap 202 connected to the first ear flap 118, the details described herein can be implemented using different attachment components on the first ear flap 118, second ear flap 120, or other components of the helmet body 102, such as the crown portion 108, the forehead portion 110, the rear portion 112, the first side portion 114, the second side portion 116, the first ear flap 118, and/or the second ear flap 120.

Figure 4B:
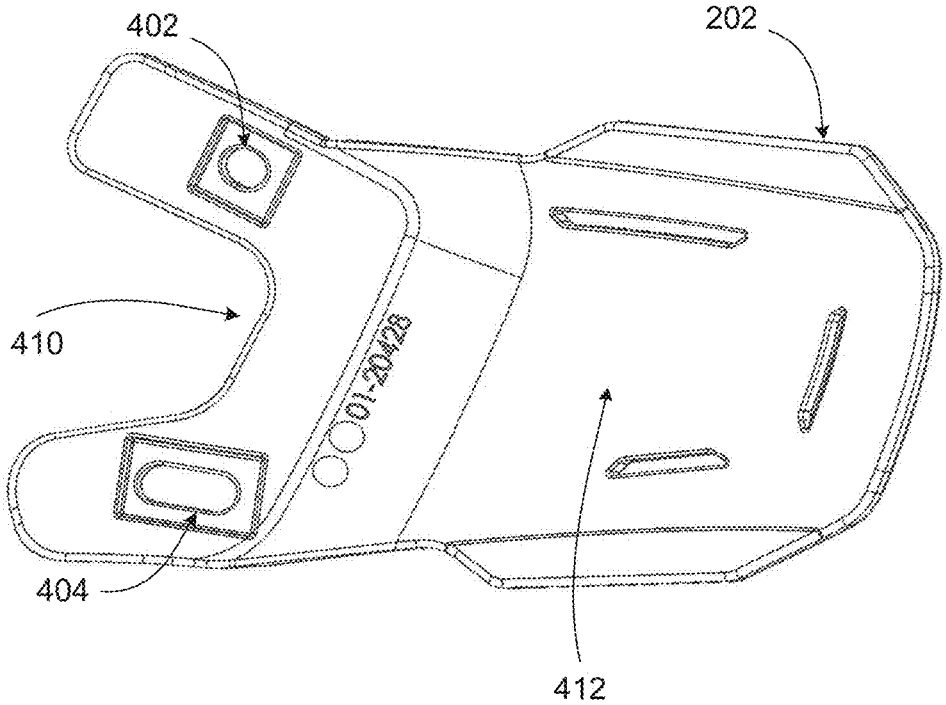
FIG. 4B is a perspective, interior view of the jaw flap for connection with the example helmet of FIGS. 2-3.

FIG. 4B is a perspective, interior view of the jaw flap for connection with the second example helmet 200' as shown in of FIG. 4A.

As shown in FIG. 4B, the jaw flap 202 includes a fork-like shape 410 formed at one end of the jaw flap 202. The interior surface of this fork-like shape 410, as depicted in FIG. 4B, is recessed relative to the adjacent forward portion 412 of the jaw flap 202. The fork-like shape 410 corresponds to the shape of a portion of the ear hole 414 and when the jaw flap 202 is connected to the inner helmet surface, the recessed portion of the fork-like shape 410 together with it partial surrounding of the ear hole 414 on the inner helmet surface results in an exterior view that reflects a fluid and continuous look of the ear flap/helmet when connected with the jaw flap 202. Indeed, this flush and continuous external view is achieved in part by the higher, adjacent forward portion 412 of the jaw flap (relative to its recessed portion) being generally in the same plane as the outer surface of the helmet shell (i.e., helmet body 102) when the jaw flap is connected to the helmet shell.

Figure 4C:
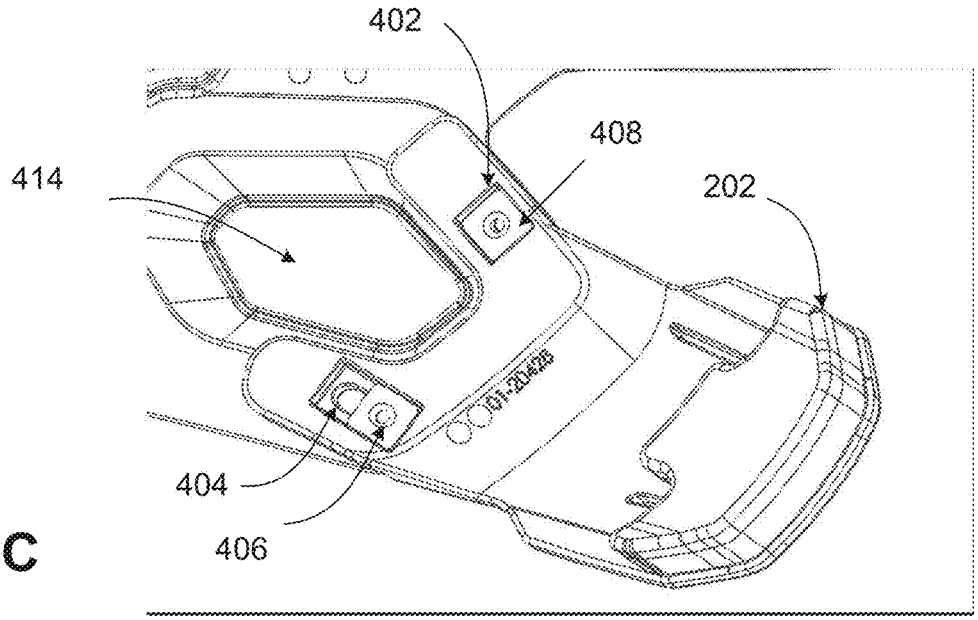
FIG. 4C is a partial, perspective interior view of the jaw flap as connected to the example helmet of FIGS. 2-3.

Although a fork-like shape 410 of the jaw flap 202 is depicted in FIGS. 4B and 4C, one skilled in the art will appreciate that this shape of the jaw flap 202 (or another attachment component) can be varied and can be shaped so as to allow a flush and integrated view of the helmet shell (i.e., helmet body 102) when connected to the attachment component.

Moreover, to removably connect the jaw flap 202 to the inner helmet surface 106, through-holes 402 and 404 in the jaw flap can be aligned with the through-holes formed in the helmet 200' at locations 204/206 (upon removal of corresponding removable plugs from these locations) and a rotational mechanical fastener (e.g., a screw, T-nut) can be used to removably couple the jaw flap 202 to the inner surface of the helmet via the aligned through-holes. As depicted in FIGS. 4B and 4C, each of the through-holes 402 and 404 is configured to receive a T-nut 406/408 to couple the jaw flap 202 to the inner surface of the helmet. Although the jaw flap 202 is depicted as including two through-holes, it will be appreciated that fewer or more through-holes could be provided therein. Similarly, although the ear flap portion 118 of the example helmet 200 is depicted in FIG. 3 and in FIGS. 4B-4C as including two through-holes (e.g., formed upon removal of removable plugs from those locations of the helmet), it will be appreciated that fewer or more through-holes (or locations with removable plugs) could be provided therein.

Figure 4D:
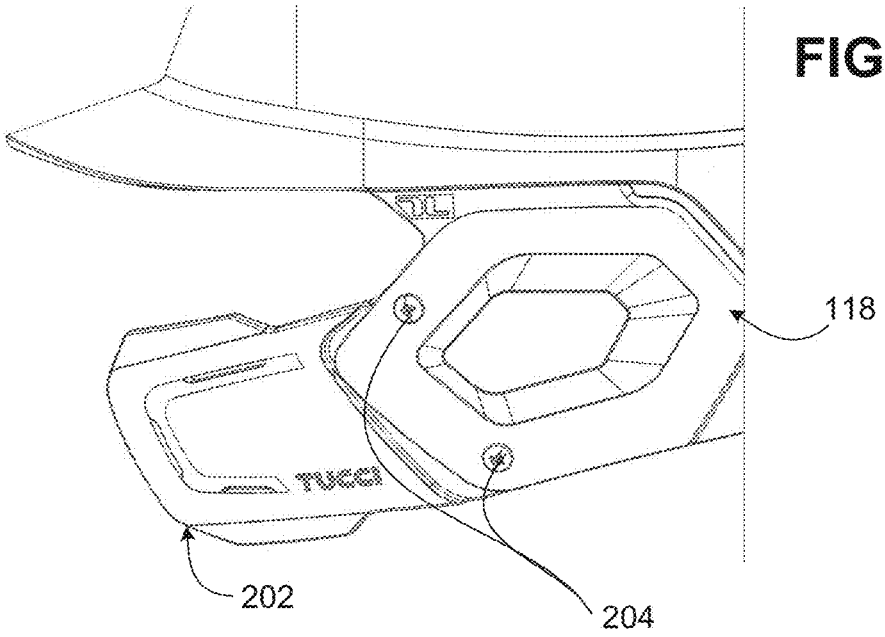
FIG. 4D is partial right perspective view of the example helmet of FIGS. 2-3 showing an ear flap portion of the helmet connected to a jaw flap in a first, articulated position.
Figure 4E:
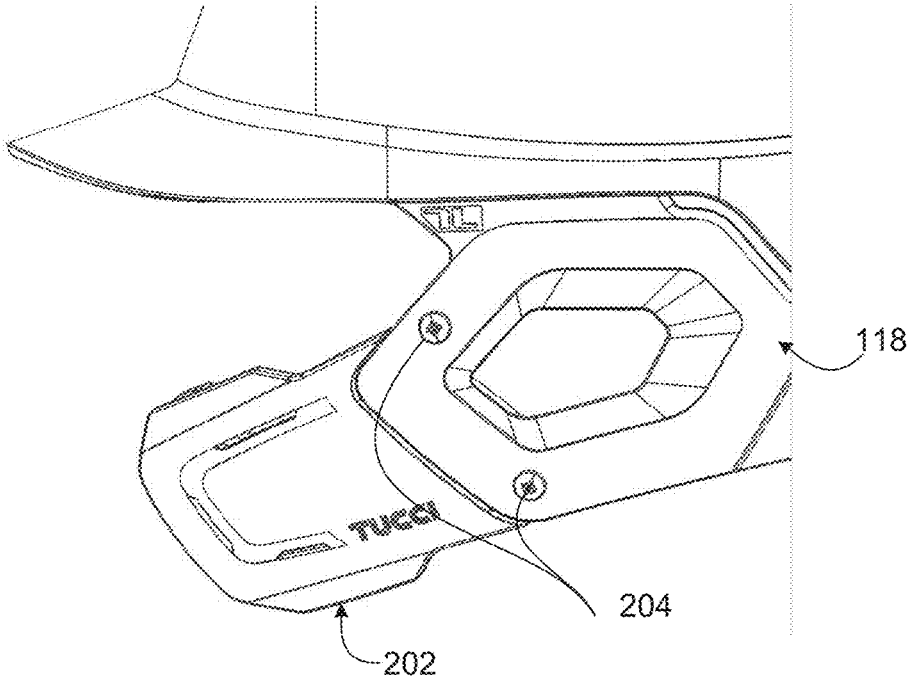
FIG. 4E is partial right perspective view of the example helmet of FIGS. 2-3 showing an ear flap portion of the helmet connected to a jaw flap in a second, unarticulated position.

Moreover, as depicted in FIG. 4B, the through-hole 404 on the jaw flap 402 is larger (as shown in FIGS. 4B and 4C, this through-hole 404 forms a slot-like oval shaped opening) than the through-hole 402. The slot-shaped through-hole 404, which is laterally larger than the fastening mechanism (e.g., T-nut) that is used to connect the jaw flap 202 to the inner helmet surface, allows for articulation of the jaw flap 202 upon being connected to the inner helmet surface. For example, as shown in FIG. 4D, the slot-shaped through hole 404 allows for an upward articulation or swivel of the jaw flap 202 (when connected to the inner helmet surface) from an un-articulated position as shown in FIG. 4E.

Although FIGS. 4B and 4C depict the slot-shaped through-hole 404 formed at the lower connection point of the jaw flap 202, the slot-shaped through-hole 404 could alternatively or additionally be formed at the location of the through-hole 402 in the jaw flap 202. The slot-shaped through-hole at the upper connection point (402) facilitates a downward articulation or swivel of the jaw flap 202 from an un-articulated position as shown in FIG. 4E. And, if both the through-holes 402 and 404 have the above-described slot shape, the jaw flap 202 connected to an inner helmet surface would then be capable of articulating or swiveling in both the upward and downward directions. One skilled in the art will further appreciate that the slot-shaped through-holes could be turned or repositioned (or a pin-like structure could be used) to facilitate forward or rearward extension of the jaw flap 202 (relative to the front opening of the helmet shell).

Alternatively, instead of one or more slots being formed in the jaw flap 202, one or more slots could be formed in the through-holes formed in the helmet shell (e.g., upon removal of the removable plugs that may be located there) and doing so, would achieve the same uni-directional, bi-directional, or multi-directional articulation described above.

Alternatively, instead of one or more slots being formed in the jaw flap 202 or the helmet shell, a separate connection component (e.g., a plastic insert) including a slot-shaped through-hole can be disposed between the through-holes formed in the helmet shell and the jaw flap 202, and doing so would thus again achieve the same uni-directional, bi-directional, or multi-directional articulation described above (without needing to form the larger holes and/or removable plugs forming such holes in the jaw flap or the helmet body).

Figure 9:
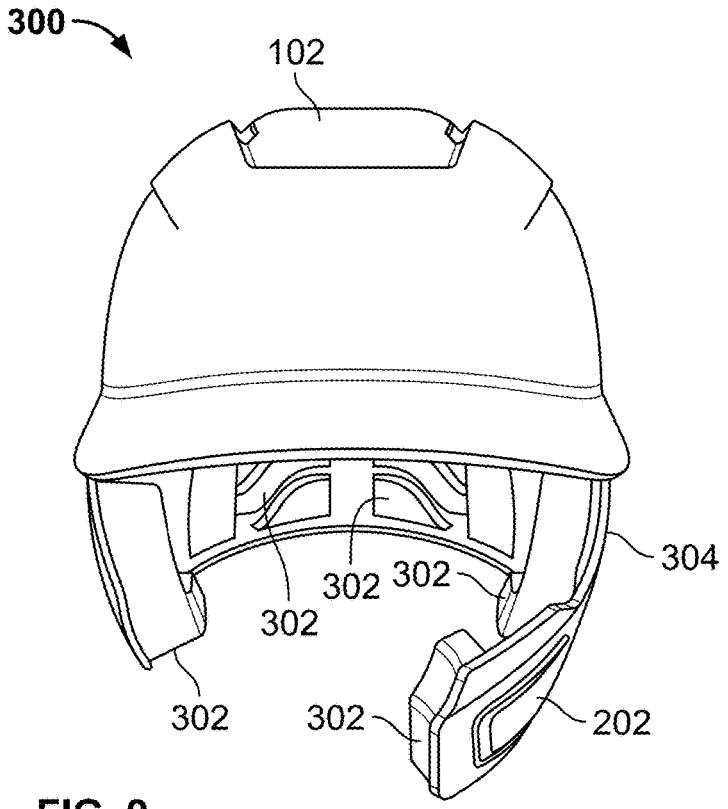
FIGS. 9, 10, and 11 are a front view, a perspective view, and a rear view, respectively, of a third example helmet including a removable jaw flap and impact mitigating pads.
Figure 10:
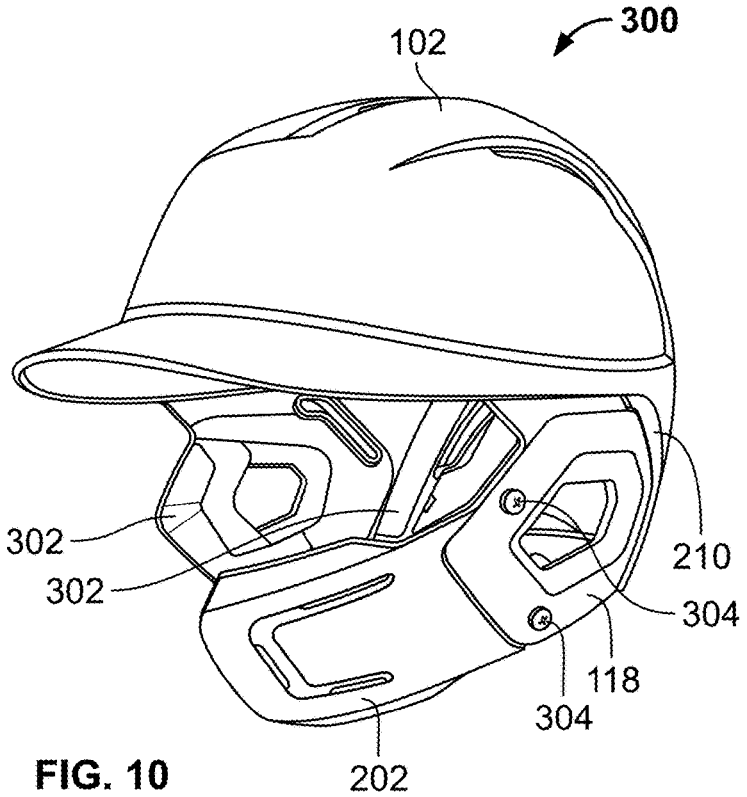
Figure 11:
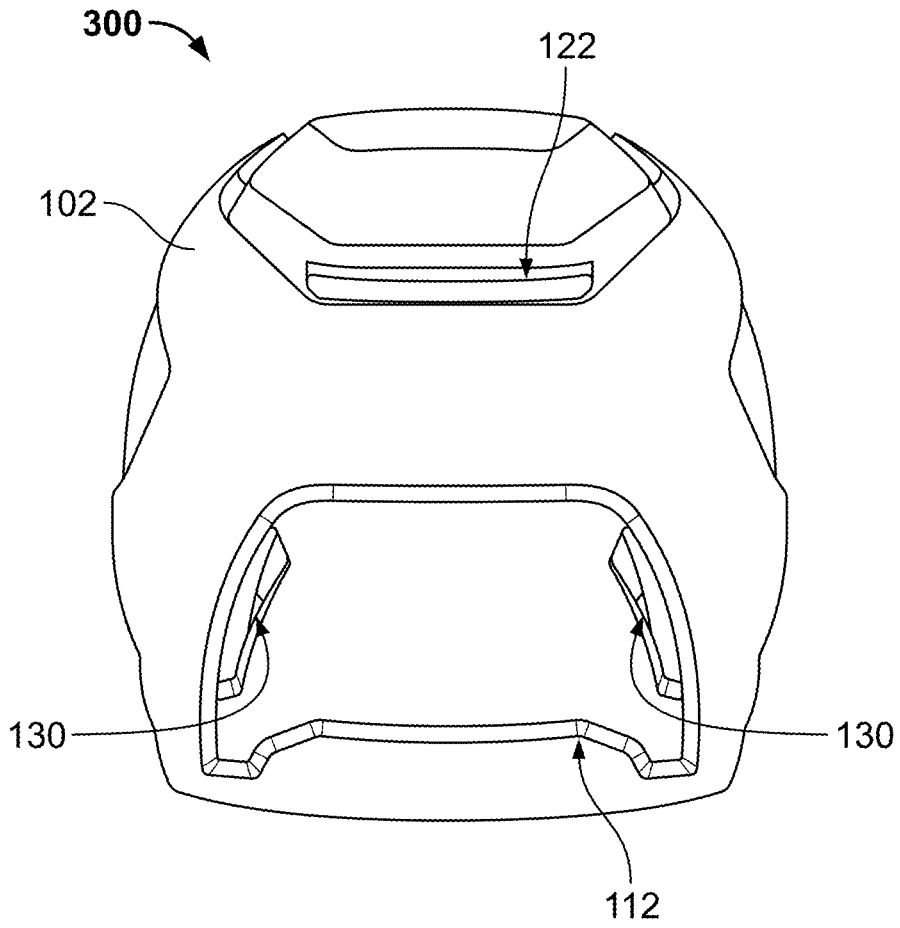

FIGS. 9, 10, and 11 are a front view, a perspective view, and a rear view, respectively, of a third example helmet 300 including the removable jaw flap 202 and impact mitigating pads 302 affixed to the inner helmet surface 106. The third example helmet 300 is the same as the second example helmet 200 of FIGS. 2-3, except the third example helmet 300 includes the impact mitigating pads 302 affixed to the inner helmet surface 106 and includes screw fasteners 304 through the through-holes formed in the first set of locations 204 (upon removal of removable plugs from this first set of locations 204) for coupling the jaw flap 202 to first ear flap 118 of the helmet body 102. The impact mitigating pads 302 are connected to the inner helmet surface 106 with a connector(s), such as a hook-and-loop fastener, adhesive, or other type of connector. The connector allows for one or more or all of the impact mitigating pads 302 to be removable and re-affixable to the helmet body 102. Impact mitigating pads that can be used as the impact mitigating pads 302 of the third example helmet 300 are described earlier in this disclosure.

Figure 12:
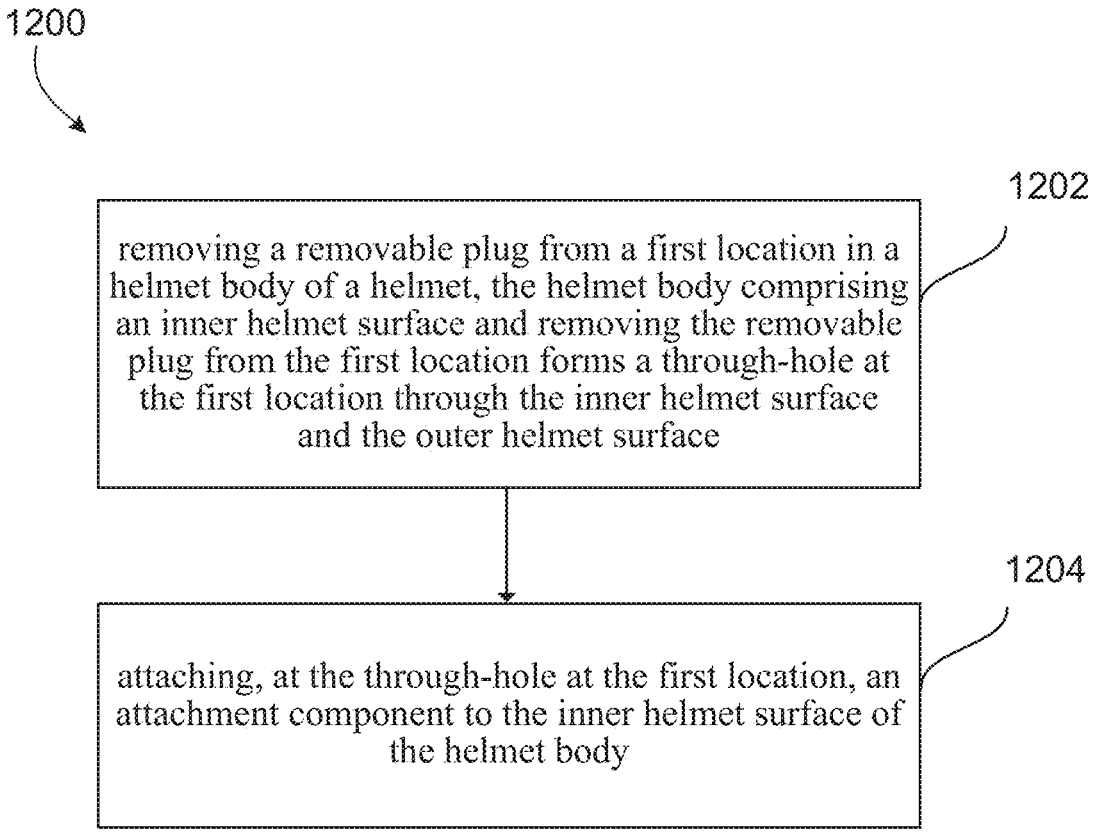
FIG. 12 is a flowchart describing an example method 900 for assembling a helmet.

FIG. 12 is a flowchart describing an example method 1200 for assembling a helmet, such as the first example helmet 100 of FIG. 1, the second example helmet 200 of FIGS. 2 and 3, or the third example helmet 300 of FIGS. 9-11. At 1202, a removable plug is removed from a first location on a helmet body of a helmet. The helmet body includes an inner helmet surface and an outer helmet surface, and removing the removable plug from the first location forms a through-hole at the first location through the inner helmet surface and the outer helmet surface. At 1204, an attachment component is attached to the inner helmet surface of the helmet body at the through at the first location. The removable plug can be molded into the helmet body at the first location, and removing the removable plug can include pushing out the removable plug from the helmet body to expose the through-hole at the first location. Pushing out the removable plug can be done using a push tool acting against the removable plug, with the application of manual force against the removable plug, or other applications of force. In certain implementations, removing the removable plug includes removing a first set of removable plugs from a first set of locations on the first side (e.g., first ear flap) of the inner helmet surface, and attaching the attachment component includes attaching a jaw flap with an attachment mechanism at through-holes formed at the first set of locations (upon removal of the removable plugs from this first set of locations). Prior to removing the first set of removable plugs, a first impact mitigating pad can be removed from the first side of the inner helmet surface. After attaching the jaw flap to the first side of the inner helmet surface, the first impact mitigating pad can be affixed to the jaw flap. In some implementations, a second set of removable plugs are removed from a second set of location on a second side (e.g., second ear flap) of the inner helmet surface, and a second attachment component is attached to the second side at the second set of locations (upon removal of the removable plugs from this second set of locations) with a second attachment mechanism.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

Particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A baseball batter's helmet comprising:

a helmet body comprising an inner helmet surface and an outer helmet surface; and a removable jaw flap removably connected, to the inner helmet surface of an ear flap portion of the helmet body, the removable jaw flap engaging the inner helmet surface, wherein the removable jaw flap comprises:

a first portion comprising a first end having a shape corresponding to a portion of the ear flap portion and an outer attachment surface contacting an inner surface of the ear flap portion of the helmet body; and a forward portion adjacent to the first portion, the forward portion comprising an extension beyond a front opening of the helmet body in a forward direction relative to the front opening of the helmet body.

2. The baseball batter's helmet of claim 1, further comprising:

at least one slot formed in the removable jaw flap that receives a rotational mechanical fastener for fastening the first portion of the removable jaw flap to the inner helmet surface, the at least one slot configured to allow articulation of the removable jaw flap when connected to the inner helmet surface.

3. The baseball batter's helmet of claim 2, wherein the at least one slot comprises two slots and a separate rotational mechanical fastener engages each of the two slots to removably connect the removable jaw flap to the inner helmet surface.

4. The baseball batter's helmet of claim 2, wherein the removable jaw flap can be articulated in an upward direction, a downward direction, the forward direction, or a rearward direction.

5. The baseball batter's helmet of claim 2, further comprising:

a through-hole through the inner helmet surface and the outer helmet surface at a first location of the helmet body; and wherein the removable jaw flap is removably connected to the inner helmet surface using the rotational mechanical fastener at the through-hole.

6. The baseball batter's helmet of claim 1, further comprising:

at least one slot formed in the inner helmet surface that receives a rotational mechanical fastener for fastening the inner helmet surface to the removable jaw flap, the at least one slot configured to allow articulation of the removable jaw flap when connected to the inner helmet surface.

7. The baseball batter's helmet of claim 1, further comprising:

at least one slot formed in a connection component that is disposed between an outer surface of the removable jaw flap and the inner helmet surface, the at least one slot formed in the connection component configured to allow articulation of the removable jaw flap when connected to the inner helmet surface.

8. The baseball batter's helmet of claim 1, wherein an outer surface profile of the removable jaw flap matches an inner surface profile of the ear flap portion of the helmet body.

9. The baseball batter's helmet of claim 1, wherein the outer attachment surface contacts a recessed portion on the inner helmet surface.

10. The baseball batter's helmet of claim 1, wherein the shape of the first end comprises a recessed portion relative to the forward portion adjacent to the recessed portion.

11. The baseball batter's helmet of claim 10, wherein the forward portion is generally in a same plane as an outer surface of the helmet body when the removable jaw flap is connected to the helmet body.

12. The baseball batter's helmet of claim 1, further comprising an impact mitigating pad affixed to the removable jaw flap.

13. The baseball batter's helmet of claim 12, wherein a portion of the removable jaw flap is disposed between the impact mitigating pad and the ear flap portion of the helmet body.

14. The baseball batter's helmet of claim 1, further comprising an impact mitigating pad disposed on an inner surface of the forward portion of the removable jaw flap.

15. The baseball batter's helmet of claim 1, wherein the first end of the first portion comprises a fork-like shape corresponding to an ear hole in the ear flap portion of the helmet body.

16. The baseball batter's helmet of claim 1, wherein the first portion comprises a fork-like shape recessed relative to the forward portion.

17. The baseball batter's helmet of claim 1, wherein the forward portion comprises a flush outer surface profile with respect to the ear flap portion of the helmet body.

18. The baseball batter's helmet of claim 1, wherein the removable jaw flap is shaped to provide a substantially flush outer surface profile between the ear flap portion of the helmet body and the removable jaw flap.

19. The baseball batter's helmet of claim 1, wherein the first end of the first portion comprises:

an upper through-hole; and a lower through-hole larger than the upper through-hole.

20. The baseball batter's helmet of claim 19, wherein:

the first end corresponds to a shape of a portion of an ear hole in the ear flap portion; and the lower through-hole is disposed below the portion of the ear hole.

21. The baseball batter's helmet of claim 1, wherein:

the first portion is recessed relative to the forward portion; and the first end of the first portion comprises:

an upper through-hole; and a lower through-hole larger than the upper through-hole.

22. The baseball batter's helmet of claim 21, wherein the first end comprises a fork-like shape including the upper through-hole and the lower through-hole.

23. The baseball batter's helmet of claim 21, further comprising an impact mitigating pad affixed to the first portion of the removable jaw flap, wherein the first portion of the removable jaw flap is disposed between the impact mitigating pad and the ear flap portion of the helmet body.

24. A baseball batter's helmet comprising:

a helmet body including an ear flap portion comprising a first through-hole, the helmet body comprising an inner helmet surface and an outer helmet surface; and an attachment component comprising:

a recessed portion comprising a second through-hole removably connected to the inner helmet surface of the ear flap portion of the helmet body at the first through-hole using a rotational mechanical fastener; and a forward portion adjacent to the recessed portion, the forward portion comprising an extension beyond a front opening of the helmet body in a forward direction relative to the front opening of the helmet body.

25. The baseball batter's helmet of claim 24, wherein the second through-hole is larger than the rotational mechanical fastener such that the forward portion is articulatable relative to the helmet body.

26. A baseball batter's helmet comprising:

a helmet body comprising an inner helmet surface and an outer helmet surface; and a removable jaw flap removably connected to the inner helmet surface of an ear flap portion of the helmet body, the removable jaw flap engaging the inner helmet surface, wherein the removable jaw flap comprises:

a first portion comprising a first end having a shape that extends above and below a front edge of an ear hole in the ear flap portion and an outer attachment surface contacting an inner surface of the ear flap portion of the helmet body; and a forward portion adjacent to the first portion, the forward portion comprising an extension beyond a front opening of the helmet body in a forward direction relative to the front opening of the helmet body; and an impact mitigating pad removably attached to the inner surface of the ear flap portion of the helmet body.

* * * * *